United States Patent [19]

Nelson et al.

[11] Patent Number: 4,588,110

[45] Date of Patent: May 13, 1986

[54] PORTABLE WATERPROOFING APPARATUS

[75] Inventors: Dale K. Nelson, Minneapolis; Allen D. Mathison, Richfield, both of Minn.

[73] Assignee: Cherne Industries, Inc., Minneapolis, Minn.

[21] Appl. No.: 699,595

[22] Filed: Feb. 8, 1985

[51] Int. Cl.[4] ..... B67D 5/52

[52] U.S. Cl. ..... 222/135; 222/275; 222/334; 222/383

[58] Field of Search ..... 222/265, 135, 137, 275, 222/373, 384, 252, 253, 255, 263, 334, 325, 372, 382, 383, 630; 239/310, 332, 333, 418, 423; 417/533

[56] References Cited

U.S. PATENT DOCUMENTS

| | | | |
|---|---|---|---|
| 1,339,237 | 5/1919 | Thompson | 222/382 X |
| 1,936,997 | 11/1933 | String | 239/306 |
| 2,136,024 | 11/1938 | Schneider | 239/306 |
| 2,511,626 | 6/1950 | Einbecker | 239/304 |
| 2,558,681 | 6/1947 | Hachmeister | 239/332 X |
| 2,578,102 | 12/1951 | Stephenson et al. | 222/334 X |
| 2,584,178 | 2/1952 | Abbott | 239/418 |
| 2,813,751 | 11/1957 | Barrett | 239/306 |
| 2,819,928 | 1/1958 | Liedberg | 222/334 X |
| 3,042,266 | 7/1962 | Mies | 222/382 X |
| 3,050,261 | 8/1962 | Littlefield | 239/418 X |
| 3,055,596 | 9/1962 | Pope | 239/418 X |
| 3,790,030 | 2/1974 | Ives | 222/135 |
| 3,804,299 | 4/1974 | Kain | 222/135 X |
| 3,833,156 | 9/1974 | Hough | 222/383 |
| 4,278,132 | 7/1981 | Hostetter | 239/310 |
| 4,341,350 | 7/1982 | Wemmer | 239/312 |
| 4,516,700 | 5/1985 | Guzowski | 222/383 X |

*Primary Examiner*—Joseph J. Rolla
*Assistant Examiner*—P. McCoy Smith
*Attorney, Agent, or Firm*—Anthony G. Eggink

[57] ABSTRACT

The portable, light-weight pumping mechanism is for transferring and mixing two fluids from a portable fluid container having a top portion of predetermined dimensions and having an inlet port. The portable pumping mechanism is comprised of a base cover member having an aperture therethrough and having a downwardly extending circumferential lip adapted for securing the pumping mechanism to the top of the portable fluid container. A frame structure is mounted to the top of the base cover member and a pair of interconnected elongated pneumatic pumps are mounted to the frame structure. One of the pneumatic pumps is connectable to a compressed air source. A downwardly extending pickup conduit protrudes through the aperture in the base cover member to sealingly engage the inlet portion of the container and it is further in communication with one of the pumps for removing fluid from the portable fluid container. A catalyst inlet portion is in communication with the second pump and an elongated flexible hose assembly which is comprised of two parallel and connected hoses are in communication with the first and second pumps. A mixing and ejecting probe assembly is disposed at the end of the hose assembly for transferring the fluid mixture to a predetermined location for sealing purposes.

20 Claims, 4 Drawing Figures

PORTABLE WATERPROOFING APPARATUS

BACKGROUND OF THE INVENTION

The invention deals generally with a portable pumping apparatus to transfer and mix fluids of varying viscosities. Particularly, this invention deals with a portable and lightweight pumping apparatus used for waterproofing purposes and which is adaptable to a sealant container to transfer a sealant fluid therefrom for mixing with a catalyst solution.

The portable waterproofing apparatus of the invention is useful for providing a lightweight apparatus that enables a user to mix two fluids having a wide viscocity range. For example, the portable waterproofing apparatus is useful by individuals and small crews to seal groundwater leaks that invade most manholes, to seal basement walls and to seal piping areas that protrude through building wall areas. And, the apparatus of the invention provides a method of sealing in a quick, effective and economical manner.

The portable waterproofing apparatus is for engaging the top portion of a portable sealant container having an openable inlet port and to transfer and mix the sealant from the container with a catalyst supply for sealing manhole leaks, building wall areas, and other difficult to reach areas.

In the past, various fluid mixing devices have been proposed to transfer fluids. However, these devices have been bulky, designed for various specific purposes, have utilized complex and delicate electronic and pneumatic controls and have been otherwise unsuited and expensive for manhole area sealing purposes. The portable waterproofing apparatus of this invention overcome the limitations and shortcomings of these prior art devices.

The portable apparatus is designed to utilize fluid systems that are effective and readily accessible. And, the apparatus of this invention fulfils a longstanding need for such a fluid pumping and dispensing system.

SUMMARY OF THE INVENTION

This invention provides a portable, light-weight pumping mechanism for transferring and mixing two fluids of varying viscosity, one of the fluids being transferred from a portable fluid container having a top portion of a predetermined diameter and having an openable inlet port. The invention also provides a method for transferring and mixing two fluids of various viscosity ranges.

The portable pumping mechanism is comprised of a base cover member having an aperture therethrough and having a downwardly extending circumferential lip adapted for securement to the top of the portable fluid container.

A frame structure is mounted on the top of the base cover member and a pair of interconnnected elongated pneumatic pumps are mounted to the frame structure. One of the pneumatic pumps being connectible to an air source or compressed air supply.

A downwardly extending pickup tube protrudes through the aperture in the base cover member and is in communication with one of the pumps for removing fluid from the portable fluid container when placed through the inlet port of the container. The pickup tube further has a sealing ring with vent means thereabout for sealingly engaging the openable inlet port of the container.

A catalyst inlet portion is in communication with the second pump and an elongated flexible hose assembly which is comprised of two parallel and connected hoses is in communication with the first and second pumps. The hose assembly further has a mixing and ejecting probe end with a vortex zone for transferring the fluid mixture to a predetermined location for sealing purposes.

Additionally, the portable pumping mechanism has elongated pneumatic pumps that are mounted at an acute angle with respect to the base cover member. And, the portable pumping mechanism has a first pump having an air pressure regulator and other control mechanisms to control fluid flow ratios.

The portable pumping mechanism is further provided with a base cover member and frame structure constructed of cast aluminum. And, the mixing and ejecting probe is constructed of a pair of open, facing and contoured rigid conduit portions to define a vortex zone for mixing of the fluids.

Additionally, provided by the invention are portable pumping mechanisms having mixing and ejecting probe assemblies having handle member portions and shut-off valves for fluid flow control. And, the portable pumping mechanisms are further provided with a catalyst inlet portion that is comprised of a conduit having a threaded connector end for removably receiving a water hose.

These and other benefits of this invention will become clear from the following description by reference to the drawings.

DESCRIPTION OF THE PREFERRED EMBODIMENTS

Figure 1:
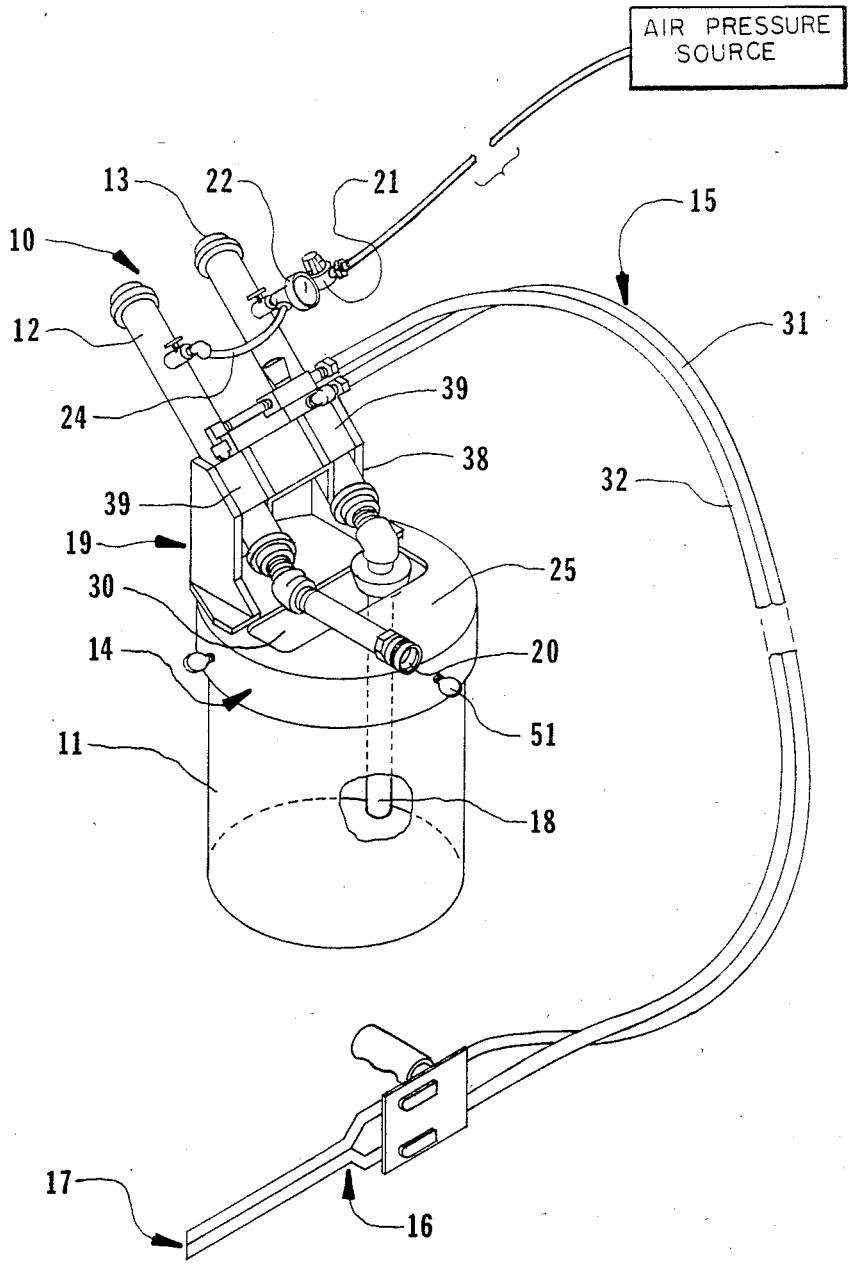
FIG. 1 is a frontal isometric view of the portable waterproofing apparatus of this invention shown in use with a container of sealant fluid.

Referring to FIG. 1 of the drawing, the portable waterproofing apparatus 10 of this invention is there illustrated in an isometric view. The portable waterproofing apparatus 10 is shown in use with a portable container 11 (i.e., 5 gal.) of a viscous urethane sealant, for example.

Portable containers 11 are known in the container art and are comprised of a can body having an upper indented ridge thereabout. A top cover member is rolled or crimped about the circumferential periphery into the container ridge to seal the container. Additionally, the top cover of the container has a handle member and an openable inlet port.

FIG. 1 shows a base cover member 14 having a downwardly extending circumferential lip 26 with fasteners or thumb screws 51 to secure the base cover 14 to container 11 by engaging the container ridge. The base cover 14 has an apertured slot 30 in its top portion 25 which permits the container handle to be accessable and to permit other elements of the apparatus to engage the container 11.

A bracket frame 19 having an upwardly extending vertical portion 38 and a horizontal portion 39 are shown to hold two elongated pneumatically operated pumps 12 and 13 that communicate via interconnect tubing 24.

Figure 2:
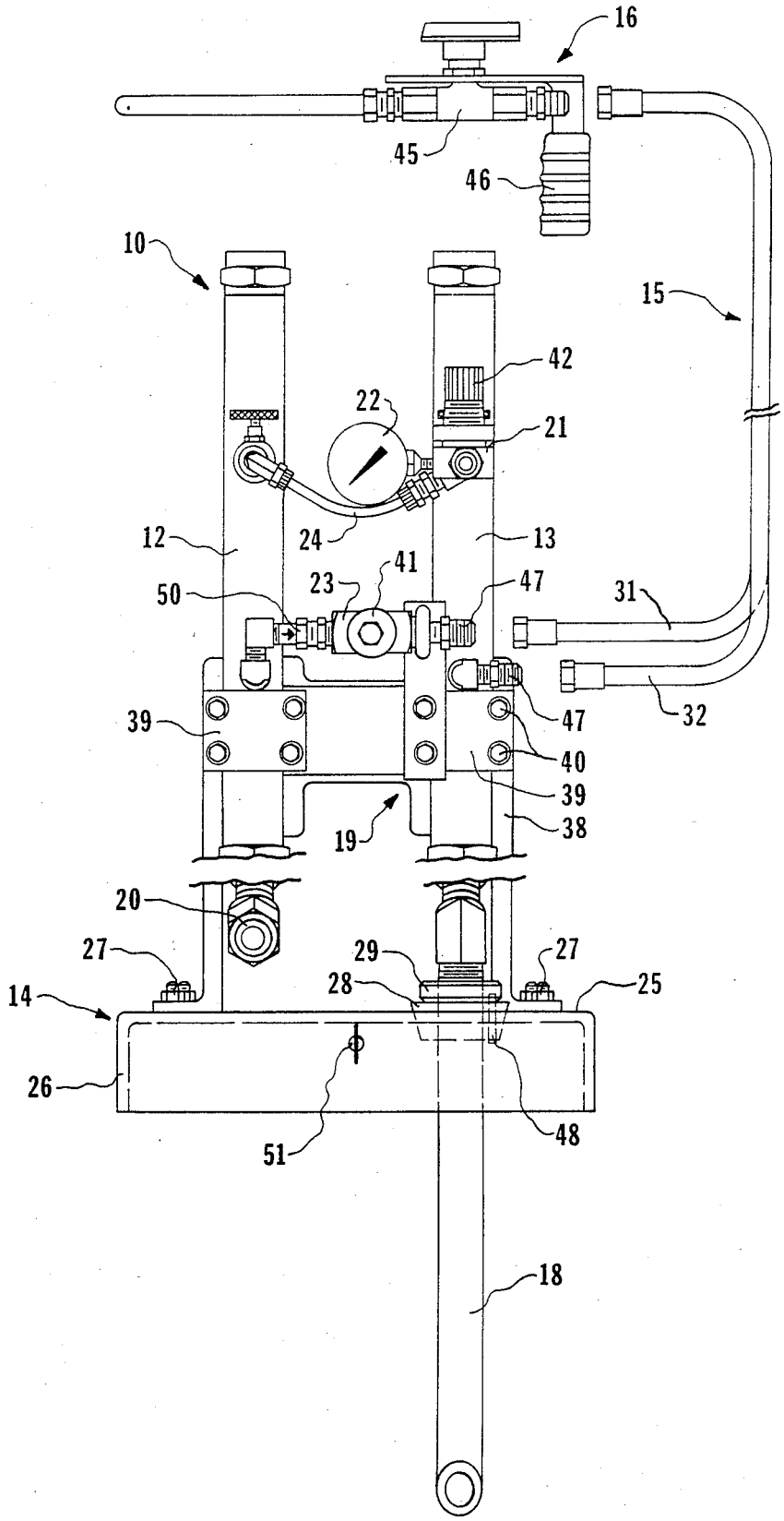
FIG. 2 is a frontal plan view of the portable waterproofing apparatus of this invention.
Figure 3:
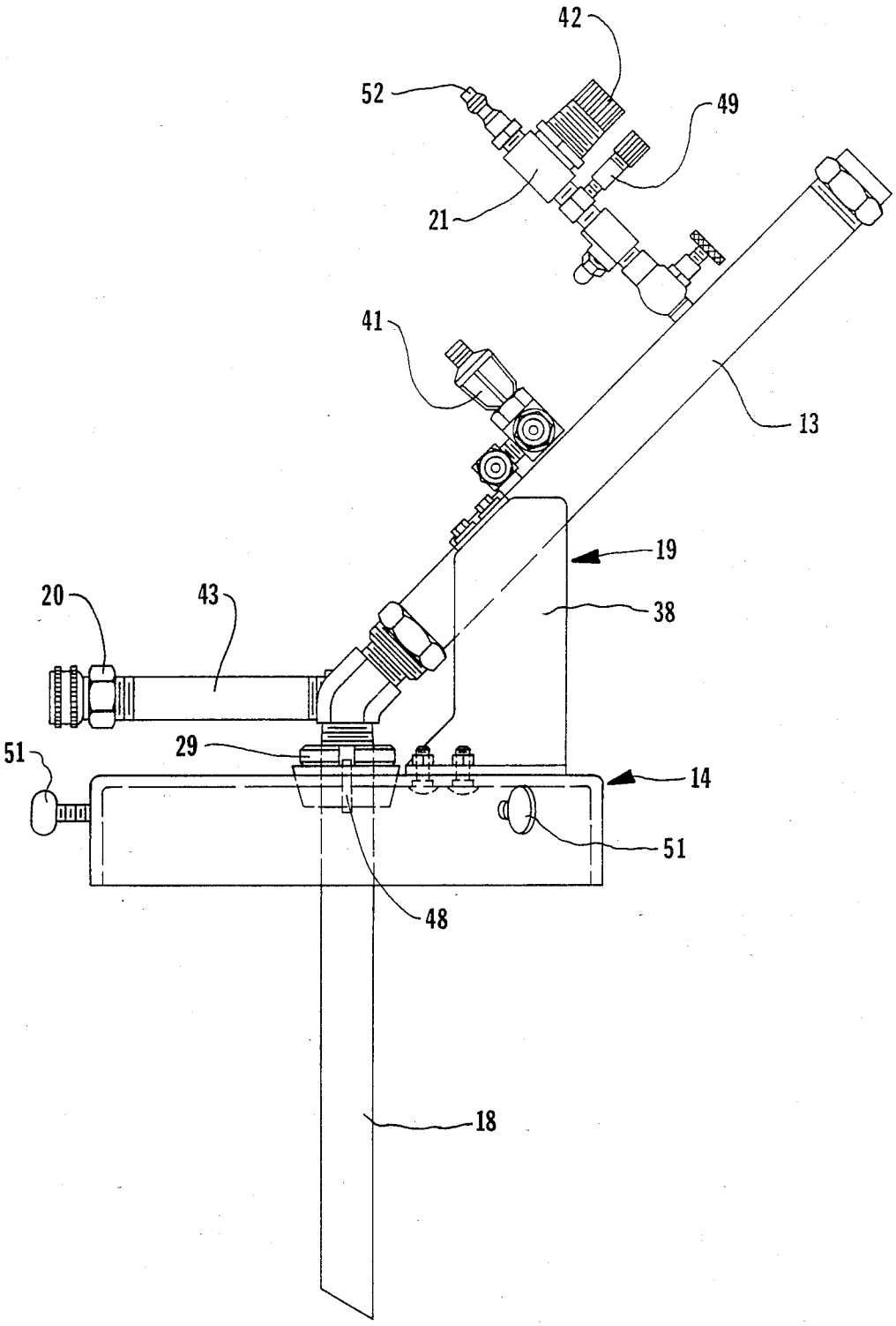
FIG. 3 is a lateral plan view of the portable waterproofing apparatus shown in FIG. 2.

FIGS. 2 and 3 further show the vertical and horizontal frame bracket members 38 and 39 being fastened by means of bolts and washers 40 to secure pumps 12 and 13. As shown, bracket member 38 has a pair of curved portions therein to receive the pumps 12 and 13. The bracket member 38 is mounted to the top 25 of base cover 14 by means of bolt and self locking nut fasteners 27.

The bracket member 38, as shown, permits the elongated pneumatic pumps to be parallelly disposed at an acute angle to make the portable pumping apparatus as compact as possible. The pumps 12 and 13 are generally mounted at a 45 degree angle with respect to the base cover member 14. Additionally, pumps 12 and 13 are 1:1 ratio pneumatic pumps wherein the outlet pressure of the pump is generally equal to the fluid supply pressure.

Pump 13 is in communication with an air supply adapter 52 which is connectable to a compressed air source of 40–100 psig. For example, a portable air compressor with a storage tank and an output of 5 cfm is suitable for such use. Additionally, the pumps 12 and 13 are equiped with air exhaust holes and a line oiler assembly 49 is provided to supply an oil mist to the pumps for lubrication purposes to extend use.

Pump 12 supplies water or a catalyst to a hose assembly 15 from a fluid source, i.e., water hose, that is connected to female connector 20. The adapter 20 receives a hose which either terminates in a container of water or catalyst solution or is connected to a water source of 45–50 psig line pressure.

Pump 13 supplies a viscous fluid, such as urethane sealant, from container 11 through a chemical pickup tube 18 for transfer to the hose assembly 15. The hose assembly 15, approximately 25 feet in length, is comprised of a pair of flexible elongated and connected flexible hoses 31 and 32.

FIGS. 2 and 3 further illustrate the portable water proofing apparatus or pumping mechanism 10 as having an air pressure regulator 21 with control knob 42, an air pressure gauge 22 and an interconnect hose 24 between pumps 12 and 13. And, a metering valve 23 with control knob 41 and connector adapter 47 is used to control the flow of water or catalyst to the hose assembly 15.

The chemical or sealant pickup tube 18 is sealingly engageable in the inlet port of container 11 by means of a suction plug 28 and a screw and collar set 29. Additionally, a vent tube 48 extends through the flexible plug 28 to prevent container 11 from collapsing as the fluid therein is removed by the pumping mechanism 10.

Figure 4:
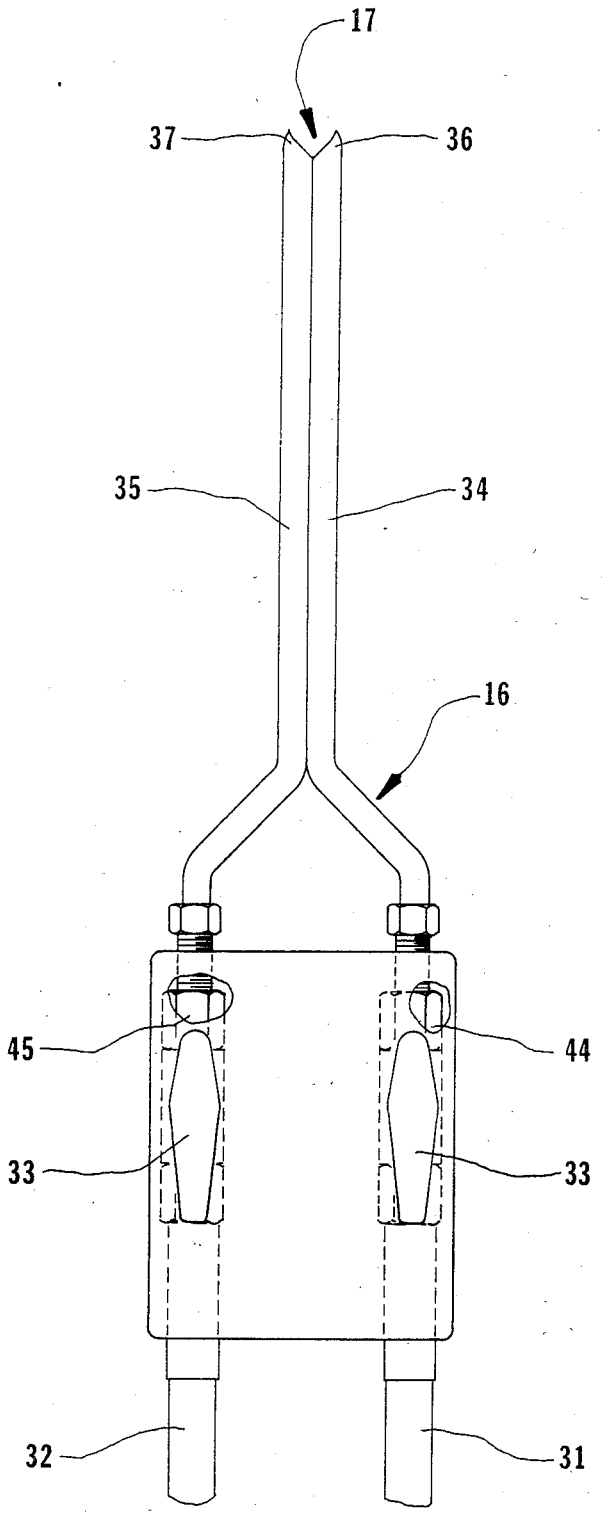
FIG. 4 is a top plan view of the mixing and ejecting probe assembly of the portable waterproofing apparatus of this invention.

FIG. 4 shows a probe and handle assembly 16 provided at the end of hose assembly 15 to mix the sealant and water or catalyst. The probe assembly 16 further has a handle portion 33, a pair of opposing rigid conduit portions 34 and 35 which join to provide a mixing head 17 having opposing curved and contoured mixing members 36 and 37 that define a vortex zone for mixing the viscous and the relatively less-viscous fluids. Additionally, a pair of shut-off valves 44 and 45 are provided so that the operator can cease the flow of fluids from flexible hoses 31 and 32 to the conduit portions 34 and 35. A handle grip member 46 is provided for gripping by the operator of the pumping apparatus.

Importantly, due to the viscosity range of the two fluids, the viscous or sealant fluid has a tendency to enter the opposing conduit portion and, thereby, causing the mixing head to block. Thus, a check valve 50 is provided at the metering valve 23 to prevent the viscous sealant, for example, from backing into the catalyst or water conduit at probe assembly 16. A forward pressure of about 15 psi has been found adequate for that purpose.

In summary, the portable waterproofing apparatus is light weight in construction and easy and reliable for use in sealing manhole area leaks, basement wall areas and other difficult to reach and crowded areas. The apparatus is pneumatically operated, and it is designed to engage the top of sealant containers of predetermined dimensions. The flow of sealant from the container 11 is controlled by the air pressure regulator 21 and the water or catalyst flow is controlled by metering valve 23.

The portable waterproofing apparatus discussed above provides a variable fluid ratio system. The inlet air pressure is used to control the chemical or sealant flow and the apparatus has been found useful in a viscocity range of 700–1400 cps for the viscous fluid. The catalyst or water fluid which is less viscous in nature has been found to have a useful range of 1–50 cps in use with the pumping apparatus and method of this invention.

As many changes are possible to the embodiments of the portable waterproofing apparatus utilizing the teachings of the invention, the descriptions above and the accompanying drawings should be interpreted in the illustrative and not the limited sense.

That which is claimed:

1. A portable, light-weight waterproofing apparatus for use with a container of a viscous sealant having a top portion of a predetermined diameter and a sealable inlet portion, said portable waterproofing apparatus comprising:

(a) a base cover portion having a downwardly extending circumferential lip having fastening means to secure the apparatus to the top portion of the sealant container, (b) a frame bracket structure attached to said base cover, (c) a first pneumatic pump mounted to said frame structure for pumping a less viscous catalyst fluid, (d) a pickup conduit for extending into the sealant container, (e) a second pneumatic pump mounted to said frame structure and being in communication with said pickup conduit for pumping the viscous sealant fluid, (f) an air pressure source connecting means with air pressure regulator and air pressure gauge to simultaneously regulate and operate said pumps, (g) a delivery hose assembly in communication with said pumps, and (h) a probe assembly having a handle portion and mixing head assembly for reacting the sealant and catalyst for subsequent transfer to a remote leak location.

2. The portable waterproofing assembly of claim 1, wherein said mixing head assembly of said probe assembly is comprised of facing and opposing contoured rigid conduit members to define a vortex mixing zone.

3. The portable waterproofing assembly of claim 1, wherein said bracket structure for mounting said first and second pumps is at an acute angle with respect to said base cover.

4. The portable waterproofing assembly of claim 1, wherein said hose assembly is a flexible elongated and connected two hose assembly.

5. The portable waterproofing assembly of claim 1, wherein said base cover and said frame bracket are constructed of a cast aluminum structure.

6. The portable waterproofing assembly of claim 1, wherein said first pneumatic pump is in communication with a fluid conduit having a threaded connector to receive a water hose.

7. The portable pumping mechanism of claim 1, wherein said pickup conduit additionally has a flexible suction plug disposed about its periphery at about its intersection with said cover member for sealingly engaging the inlet portion of the portable container.

8. The portable pumping mechanism of claim 7, wherein said flexible suction plug additionally has a vent tube extending therethrough.

9. A portable, light-weight pumping mechanism for transferring and mixing two fluids of varying viscosities, one fluid being in a portable fluid container having a top portion of a predetermined diameter and an inlet member, said portable pumping mechanism comprising:

(a) a base cover member having an aperture therethrough and having a downwardly extending circumferential lip adapted for securing the apparatus to the top of the portable fluid container, (b) a frame structure mounted on the top of said base cover member, (c) a pair of interconnnected elongated pumps mounted to said frame structure, a first pump being connectable to an air source, (d) a downwardly extending fluid intake conduit for removing fluid through the inlet portion of the portable fluid container, said intake conduit extending through said aperture of said base cover member and being in communication with one said pump, (e) a catalyst inlet portion being in communication with said second pump, and (f) an elongated flexible hose assembly comprised of two parallel and connected hoses being in communication with said first and second pumps and having a mixing and ejecting probe end for transferring the catalyst fluid mixture to a predetermined location.

10. The portable pumping mechanism of claim 9, wherein said pumps are elongated pneumatic pumps having one to one pumping ratios.

11. The portable pumping mechanism of claim 9, wherein said pumps are spacially and parallelly mounted to said frame structure at an acute angle with respect to said base cover member.

12. The portable pumping mechanism of claim 9, wherein said first pump has an air control mechanism and an air pressure gauge in communication therewith.

13. The portable pumping mechanism of claim 9, wherein said base cover member and said frame structure are constructed of cast aluminum.

14. The portable pumping mechanism of claim 9, wherein said mixing and ejecting probe is constructed of a pair of open, facing and contoured rigid conduit portions which define a vortex area for sealant and catalyst mixing.

15. The portable pumping mechanism of claim 9, wherein said mixing and ejecting probe assembly additionally has a handle member portion and a pair of shut-off valves.

16. The portable pumping mechanism of claim 9, wherein said catalyst inlet portion is comprised of a conduit having a threaded connector end for removably receiving a water hose.

17. The portable pumping mechanism of claim 9, wherein said intake conduit additionally has a flexible suction plug disposed about its periphery at about its intersection with said cover member for sealingly engaging the inlet portion of the portable container.

18. The portable pumping mechanism of claim 17, wherein said flexible suction plug additionally has a vent tube extending therethrough.

19. A process for mixing and applying a viscous and a less-viscous fluid comprising:

(a) providing a portable container of a viscous fluid having a top portion of a predetermined dimension and an openable inlet port, (b) providing a portable, light-weight pumping mechanism comprising:

(1) a base cover member having an aperture therethrough and having a downwardly extending circumferential lip adapted for securing the mechanism to the top of the portable fluid container, (2) a frame structure mounted on the top of said base cover member, (3) a pair of interconnnected elongated pumps mounted to said frame structure, a first pump being connectible to an air source, (4) a downwardly extending fluid intake conduit for removing fluid through the inlet portion of the portable fluid container, said intake conduit extending through said aperture of said base cover member and being in communication with one said pump, (5) a less-viscous fluid inlet portion being in communication with said second pump, and (6) an elongated flexible hose assembly comprised of two parallel and connected hoses being in communication with said first and second pumps and having a mixing and ejecting probe end for transferring the fluid mixture to a predetermined location, (c) securing said portable pumping mechanism to the top portion of the portable fluid container, (d) providing an air source to one said pump, and (e) connecting a second fluid source to the other said pump.

20. The process of claim 19, wherein said viscous fluid has a viscosity range of 700–1400 cps and wherein said less viscous fluid has a viscosity range of 1–50 cps.

* * * * *